US007636983B2

(12) United States Patent
Muhlenkamp

(10) Patent No.: US 7,636,983 B2
(45) Date of Patent: Dec. 29, 2009

(54) FLOOR CARE APPARATUS WITH TELESCOPING HANDLE STALK

(75) Inventor: Eric E. Muhlenkamp, Lexington, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 13 days.

(21) Appl. No.: 12/174,727

(22) Filed: Jul. 17, 2008

(65) Prior Publication Data

US 2009/0038109 A1 Feb. 12, 2009

Related U.S. Application Data

(60) Provisional application No. 60/954,670, filed on Aug. 8, 2007.

(51) Int. Cl.
*A47L 9/32* (2006.01)

(52) U.S. Cl. ..... 15/410; 15/144.4

(58) Field of Classification Search ..... 15/143.1, 15/144.1, 144.4, 410, 350, 351; 16/405, 16/429; 81/489; *A47L 9/32*
See application file for complete search history.

(56) References Cited

U.S. PATENT DOCUMENTS

| | | | |
|---|---|---|---|
| 1,918,519 | A | 7/1933 | Clements |
| 3,407,424 | A | 10/1968 | Lanzarone et al. |
| 4,319,380 | A | 3/1982 | Simm et al. |
| 4,325,157 | A | 4/1982 | Balint et al. |
| D267,711 | S | 1/1983 | Perego |
| 4,729,281 | A | 3/1988 | Holloway, Jr. |
| 4,968,174 | A | 11/1990 | Krasznai |
| 5,083,340 | A | 1/1992 | Takahashi et al. |
| 5,697,417 | A | 12/1997 | Spoon |
| 5,749,613 | A | 5/1998 | Rapp |
| 5,845,917 | A | 12/1998 | Huang |
| 5,867,862 | A | 2/1999 | Ahlf et al. |
| 6,148,474 | A | 11/2000 | Ohara et al. |
| 6,158,089 | A | 12/2000 | Monahan et al. |
| D465,705 | S | 11/2002 | Hinden |
| 6,486,396 | B2 | 11/2002 | Stein |
| 6,532,846 | B2 | 3/2003 | Lin |
| 6,546,596 | B2 | 4/2003 | Grote et al. |
| 2002/0124347 | A1 | 9/2002 | Roney et al. |

FOREIGN PATENT DOCUMENTS

| | | | |
|---|---|---|---|
| DE | 196 15 814 | A1 | 4/1996 |
| JP | 06038910 | A | 2/1994 |
| JP | 11047042 | A | 2/1999 |

*Primary Examiner*—David A Redding
(74) *Attorney, Agent, or Firm*—King & Schickli, PLLC

(57) ABSTRACT

A floor care apparatus includes a telescoping handle stalk and a handle adjustment mechanism. The handle adjustment mechanism includes a control switch, an adjustment block, a linkage connecting the control switch and adjustment block and a locking pin for securing the handle stalk in a selected position.

16 Claims, 4 Drawing Sheets

FLOOR CARE APPARATUS WITH TELESCOPING HANDLE STALK

This application claims the benefit of U.S. Provisional Patent application Ser. No. 60/954,670 filed on 8 Aug. 2007.

TECHNICAL FIELD AND INDUSTRIAL APPLICABILITY OF THE INVENTION

The present invention relates generally to the floor care equipment field and, more particularly, to a floor care apparatus incorporating a telescoping handle stalk and a handle adjustment mechanism.

BACKGROUND OF THE INVENTION

Upright vacuum cleaners, extractors and floor polishers are well-known floor care cleaning appliances. Such appliances typically include an extended handle to allow the operator to manipulate the appliance back and forth across the floor being cleaned. The present invention relates to a floor care apparatus of this type incorporating a telescopic handle stalk and a cooperative handle adjusting mechanism that allows the operator to adjust the handle to the desired length.

SUMMARY OF THE INVENTION

In accordance with the purposes of the present invention as described herein, a floor care apparatus is provided. The floor care apparatus includes a housing having a first section and a second section. A suction inlet is carried on the first section. A suction generator and dirt collection vessel are also carried on the housing. A telescoping handle stalk and control handle are received in a well carried on the second section of the housing. A handle adjustment mechanism including a control switch, an adjustment block, a linkage connecting the control switch with the adjustment block and a locking pin secure the handle stalk in a selected position in the well.

A series of spaced apertures are provided in the wall of the second section defining at least a portion of the well. A spring biases the locking pin into one of the spaced apertures so as to lock the handle stalk into a selected position in the well. The adjustment block includes a first cam surface that engages a second cam surface provided on the locking pin. The control switch is displaceable between a first position wherein the locking pin is biased by the spring into one of the spaced apertures locking the handle stalk in the selected position on the well and a second position wherein the adjustment block is shifted to displace the locking pin against the biasing force of the spring and release the locking pin from the spaced aperture. This allows the handle stalk to be repositioned in the well in order to adjust the length of the control handle.

The linkage of the handle adjustment mechanism may comprise an elongated rod. The control switch is positioned on the control handle at a proximal end of the handle stalk remote from the locking pin. The handle stalk includes a lumen and the linkage extends through the lumen between the control switch and the adjustment block.

In accordance with additional aspects of the present invention the dirt collection vessel is a dirt cup. The dirt cup includes a cylindrical sidewall, and tangentially directed inlet and an axially directed outlet. A filter may be provided in the dirt cup. In addition, the first and second sections of the housing may be pivotally connected together.

In the following description there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawing and descriptions will be regarded as illustrative in nature and not as restrictive.

BRIEF DESCRIPTION OF THE DRAWINGS

The accompanying drawings incorporated in and forming a part of this specification, illustrate several aspects of the present invention and together with the description serve to explain certain principles of the invention. In the drawings.

Reference will now be made in detail to the presently preferred embodiment of the invention, an example of which is illustrated in the accompanying drawings.

DETAILED DESCRIPTION OF THE PREFERRED EMBODIMENTS OF THE INVENTION

Figure 1:
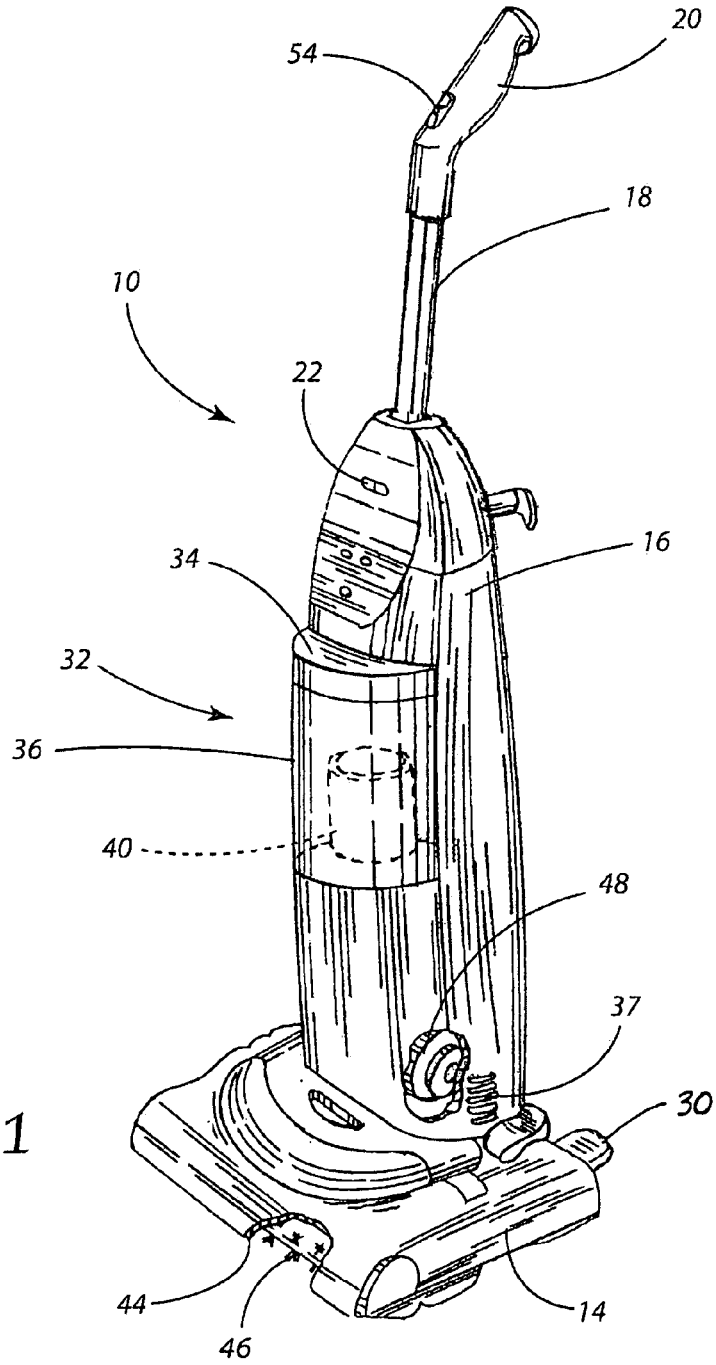
FIG. 1 is a partially cutaway perspective view of the floor cleaning apparatus of the present invention.

Reference is now made to FIG. 1 showing the upright vacuum cleaner 10 of the present invention. The upright vacuum cleaner 10 includes a housing comprising a first section or nozzle assembly 14 and a second section or canister assembly 16. The canister assembly 16 carries a telescoping handle stalk 18 and a handgrip 20. A control switch 22 is provided for turning the vacuum cleaner 10 on and off. Electrical power is supplied to the vacuum cleaner 10 from a standard electrical wall outlet through an electrical power cord (not shown).

A pair of rear wheels (not shown) are provided on the lower portion of the canister assembly 16 and a pair of front Wheels (also not shown) are provided on the nozzle assembly 14. Together, these wheels support the vacuum cleaner 10 for movement across the floor. To allow for convenient storage of the vacuum cleaner 10, a foot latch 30 functions to lock the canister assembly in an upright position as shown in FIG. 1. When the foot latch 30 is released, the canister assembly 16 may be pivoted relative to the nozzle assembly 14 as the vacuum cleaner 10 is manipulated back and forth to clean the floor.

Figure 2:
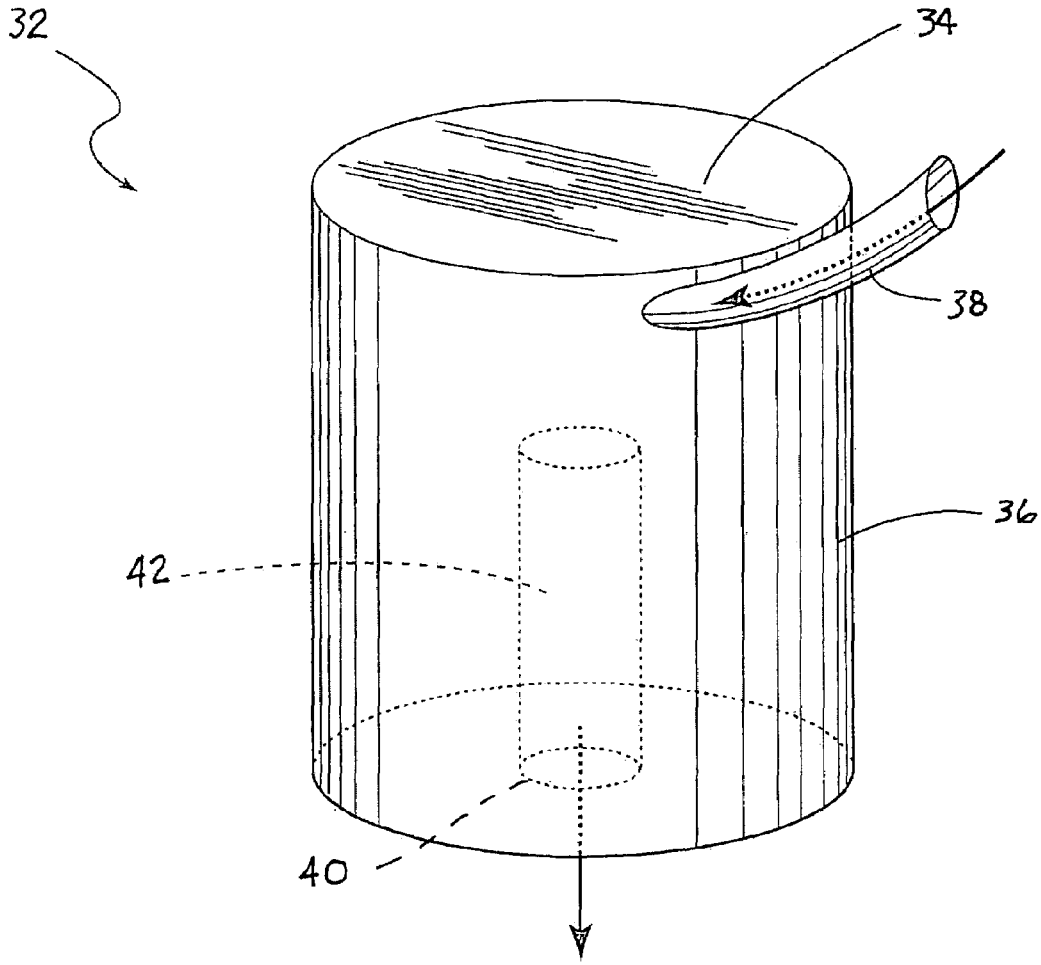
FIG. 2 is a schematical illustration of one possible embodiment of the dirt collection vessel provided on the floor cleaning apparatus.

In the presently illustrated embodiment, the canister assembly 16 includes a cavity adapted to receive and hold the dirt collection vessel 32. As illustrated in FIG. 2, the dirt collection vessel 32 may take the form of a dirt cup 34 including a cylindrical sidewall 36, a tangentially directed inlet 38 and an axially directed outlet 40. A primary filter 42 may be provided in the dirt cup 34 over the axially directed outlet 40.

The primary filter 42 is cylindrical in shape and concentrically received within the cylindrical sidewall 36 of the dirt cup 34. Such a structural arrangement induces cyclonic airflow in the dirt cup 34 and provides for enhanced cleaning efficiency. In an alternative design, the canister assembly 14 includes a closed compartment that houses a filter or vacuum cleaner bag, of a type known in the art, that functions as the dirt collection vessel 32.

The nozzle assembly 14 includes a suction inlet 44. A rotary agitator 46 is carried on the nozzle assembly 14 so as to extend across the suction inlet 44. A suction generator 48, including a fan and a cooperating drive motor, is carried on the canister assembly 16. The suction generator 48 functions to generate a vacuum air stream for drawing dirt and debris from the surface to be cleaned. The rotary agitator 46 may be connected by a power take off to the motor of the suction generator 48. Alternatively, the rotary agitator 46 may be powered by a dedicated drive motor.

During normal vacuum cleaner operation, the rotary agitator 46 is driven by the motor of the suction generator 48 and functions to beat dirt and debris from the nap of an underlying carpet. The suction generator 48 functions to draw a vacuum air stream into the suction inlet 44. Dirt and debris from the carpet is entrained in the air stream, which is then drawn by the suction generator 48 into the dirt cup 34. Dirt and debris is captured in the dirt cup 34 while relatively clean air is drawn through the primary filter 42. That air stream passes over the motor of the suction generator 48 to provide cooling before being exhausted through a final filter, such as a HEPA filter (not shown), before being exhausted through an exhaust port 37 into the environment.

Figure 3:
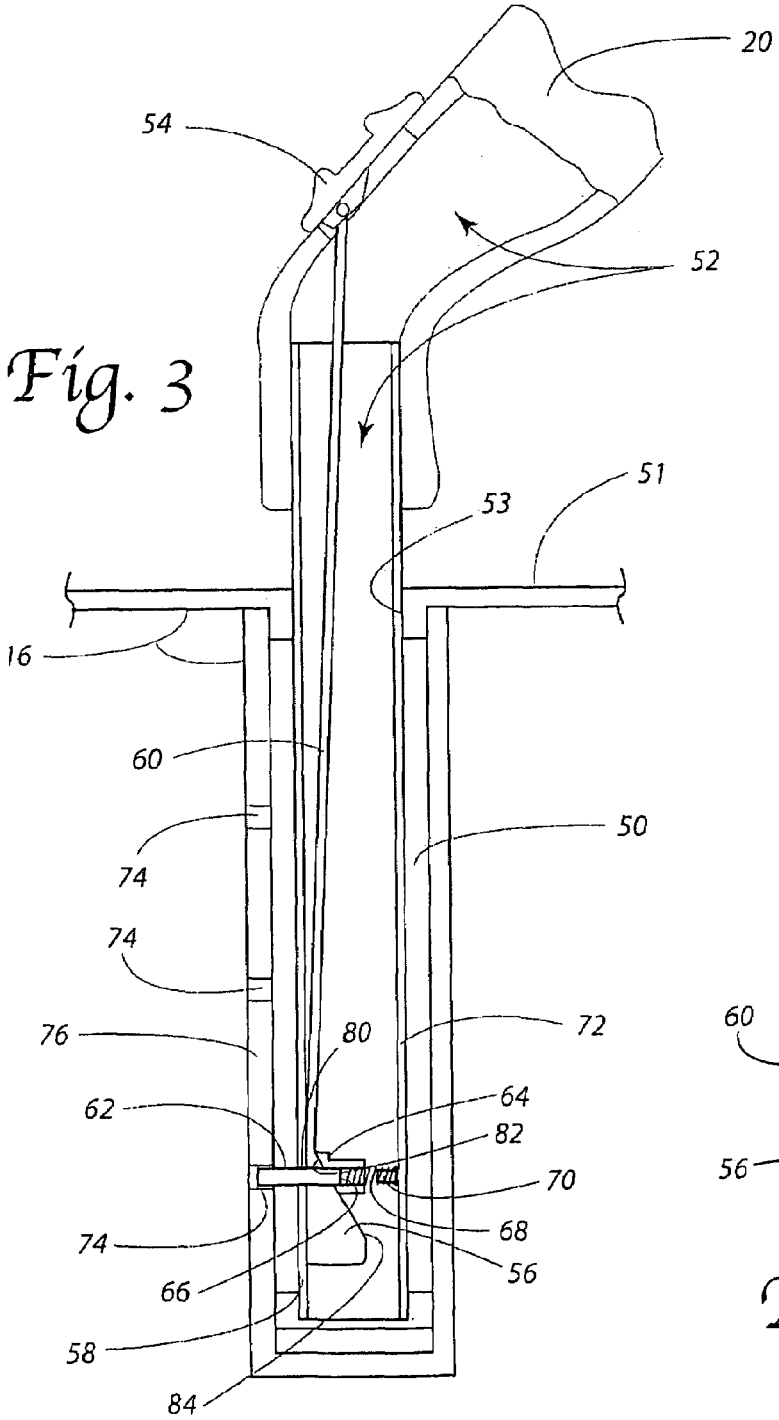
FIG. 3 is a schematical view illustrating the telescoping handle stalk and handle adjustment mechanism with the control switch in the first position wherein the locking pin is biased by a spring into one of the spaced apertures locking the handle stalk in a selected position in the well of the canister assembly.
Figure 3A:
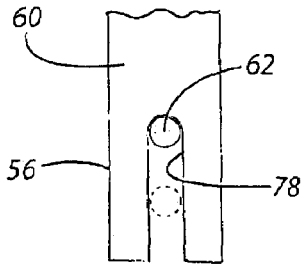
FIG. 3*a* is a detailed front elevational view of the forked adjustment block and locking pin.
Figure 4:
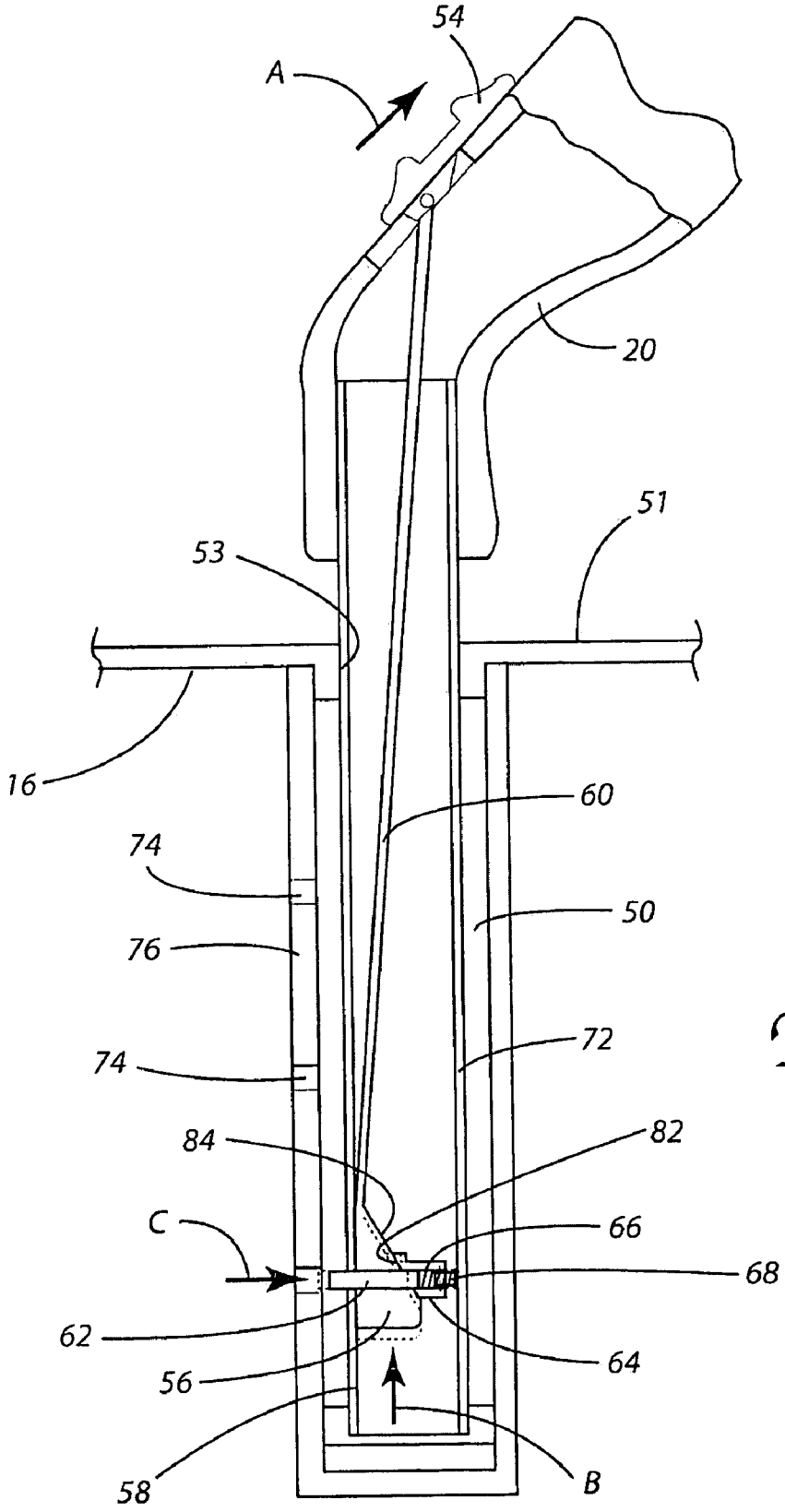
FIG. 4 is a view similar to FIG. 3 but illustrating the control switch in a second position wherein the adjustment block is shifted to displace the locking pin against the biasing force of the spring and release the locking pin from the spaced aperture so that the handle stalk may be repositioned in the well in order to adjust the length of the control handle.

As best illustrated in FIGS. 3 and 4, the handle stalk 18 is telescopingly received in a well 50 formed in the canister assembly 16. In the illustrated embodiment, the handle stalk 18 is formed from a tubular material with a square or rectangular cross section. The top wall 51 of the canister assembly 16 includes a square or rectangular opening 53. The opening 53 is sized and shaped to allow the handle stalk to freely slide in and out of the well 50 while simultaneously holding the stalk against rotation in the well. This ensures that the locking pin 62 is always aligned and oriented for receipt in one of the locking apertures 74 as will be described in greater detail below. It should be appreciated that the handle may assume other cross sectional shapes and that the anti-rotation function may be provided in another manner.

A handle adjustment mechanism, generally designated by reference numeral 52, is carried on the telescoping handle stalk 18. The mechanism includes: (a) a sliding control switch 54 on the control handle 20, (b) a forked adjustment block 56 that slides along a track on a first wall 58 within the lumen of the stalk 18, (c) a linkage in the form of a connecting rod 60 that extends through the lumen and connects the control switch and the adjustment block and (d) a locking pin 62 for securing the handle stalk in a selected position within the well 50.

The locking pin 62 includes a head 64 having a cavity 66. A compression spring 68 has a first end received in that cavity 66 and a second end held on a nib 70 carried on a wall 72 of the stalk 18. The compression spring 68 functions to bias the locking pin 62 so that an end thereof is received in one of a series of spaced locking apertures 74 formed in a wall 76 of the canister assembly 16. More specifically, the locking pin 62 extends through the elongated slot 78 in the forked adjustment block 56 and an aperture 80 in the wall 58 of the stalk 18 (see FIGS. 3 and 4)

As best illustrated in FIG. 4, the locking pin 62 is released from the spaced aperture 74 in order to allow the handle stalk 18 to be telescopingly adjusted with respect to the canister assembly 16 in order to lengthen or shorten the handle stalk as desired. As illustrated, this is accomplished by using the thumb or finger to manipulate the control switch 54. More specifically, by sliding the control switch 54 in the direction of action arrow A, the connecting rod or linkage 60 and the adjustment block 56 are displaced in the direction of action arrow B. As the adjustment block 56 moves, a cam surface 82 on the head 64 of the locking pin 62 slides along a cooperating cam surface 84 provided on the forked adjustment block. The incline of the cam surface 84 serves to displace the locking pin 62 in the direction of action arrow C. Specifically, the locking pin 62 is moved against the biasing force of the spring 68 until the end of the pin is fully removed from the spaced aperture 74 in the wall 76 of the well 50. The handle stalk 18 is then released for free sliding, telescoping movement in the well 50 of the canister assembly 16. Upon releasing the control switch 54, the biasing spring 68 forces the locking pin 62 in a direction opposite of action arrow C with the incline of the cam surface 84 engaging the cam surface 82. This functions to force the adjustment block 56 and linkage 60 in a direction opposite of action arrow B while the control switch 54 is moved in the direction opposite of action arrow A. As the handle stalk 18 is moved in or out of the well 50, the locking pin 62 is eventually aligned with another of the spaced aperture 74 provided in the wall 76 of the well 50. When this occurs, the spring 68 biases the locking pin 62 so that it projects through the wall 76 of the handle stalk 18 and is received in the aperture 74 thereby again locking the handle stalk 18 in position.

The foregoing description of the preferred embodiments of the present invention have been presented for purposes of illustration and description. It is not intended to be exhaustive or to limit the invention to the precise form disclosed. Obvious modifications or variations are possible in light of the above teachings. The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiments do not and are not intended to limit the ordinary meaning of the claims in their fair and broad interpretation in any way.

What is claimed:

1. A floor care apparatus, comprising:

a housing including a first section and a second section;

a suction inlet carried on said first section;

a suction generator carried on said housing;

a dirt collection vessel carried on said housing;

a telescoping handle stalk and control handle received in a well carried on said second section; and a handle adjustment mechanism including a control switch, an adjustment block, a linkage connecting said control switch with said adjustment block and a locking pin securing said handle stalk in a selected position in said well.

2. The apparatus of claim 1, further including a series of spaced apertures in a wall of said second section defining at least a portion of said well.

3. The apparatus of claim 2, further including a spring biasing said locking pin into one of said spaced apertures so as to lock said handle stalk in a selected position in said well.

4. The apparatus of claim 3, wherein said adjustment block includes a first cam surface, said locking pin includes a second cam surface and said first cam surface engages said second cam surface.

5. The apparatus of claim 4, wherein said control switch is displaceable between a first position wherein said locking pin is biased by said spring into one of said spaced apertures locking said handle stalk in a selected position in said well and a second position wherein said adjustment block is shifted to displace said locking pin against a biasing force of said spring and release said locking pin from said spaced aperture and thereby allow said handle stalk to be repositioned in said well in order to adjust length of said control handle.

6. The apparatus of claim 5, wherein said linkage is an elongated rod and said control switch is positioned on said control handle at a proximal end of said handle stalk remote from said locking pin.

7. The apparatus of claim 6, wherein said handle stalk includes a lumen and said linkage extends through said lumen between said control switch and said adjustment block.

8. The apparatus of claim 7, wherein said adjustment block is forked and includes an elongated slot.

9. The apparatus of claim 8, wherein said locking pin passes through said elongated slot in said forked adjustment block.

10. The apparatus of claim 9, wherein said locking pin includes a head having a cavity and an end of said spring is received in said cavity.

11. The apparatus of claim 10, wherein said second cam surface is provided on said head.

12. The apparatus of claim 1, wherein said dirt collection vessel is a dirt cup.

13. The apparatus of claim 1, wherein said dirt cup includes a cylindrical sidewall, a tangentially directed inlet and an axially directed outlet.

14. The apparatus of claim 13, further including a filter in said dirt cup.

15. The apparatus of claim 1, wherein said first section is pivotally connected to said second section.

16. A telescoping handle assembly for a floor care appliance, comprising, a telescoping handle stalk and control handle received in a well carried on a housing of the floor care apparatus; and a handle adjustment mechanism including a control switch, an adjustment block, a linkage connecting said control switch with said adjustment block and a locking pin securing said handle stalk in a selected position in a said well.

* * * * *